US007381039B2

(12) United States Patent
Sato

(10) Patent No.: US 7,381,039 B2
(45) Date of Patent: Jun. 3, 2008

(54) ROTARY COMPRESSOR HAVING A STEPPED COVER OF A DISCHARGE MUFFLER CHAMBER

(75) Inventor: Kazuya Sato, Gunma-ken (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 150 days.

(21) Appl. No.: 11/342,792

(22) Filed: Jan. 31, 2006

(65) Prior Publication Data

US 2006/0171833 A1 Aug. 3, 2006

(30) Foreign Application Priority Data

Jan. 31, 2005 (JP) ..... 2005-023111

(51) Int. Cl.
*F03C 2/00* (2006.01)
*F03C 4/00* (2006.01)
*F04C 2/00* (2006.01)

(52) U.S. Cl. ..... 418/60; 418/11; 418/149; 418/181

(58) Field of Classification Search ..... 418/11, 418/60, 63, 88, 94, 149, 181
See application file for complete search history.

(56) References Cited

U.S. PATENT DOCUMENTS 1,970,033 A * 8/1934 Dennedy ..... 417/410.3
2,124,239 A * 7/1938 Smith ..... 417/410.3
2,174,536 A * 10/1939 Smith ..... 418/97
6,732,542 B2 * 5/2004 Yamasaki et al. ..... 418/11
2005/0169787 A1 * 8/2005 Iguchi et al. ..... 418/55.1
2005/0191198 A1 * 9/2005 Sato ..... 418/60

FOREIGN PATENT DOCUMENTS

JP 02267390 A * 11/1990 ..... 418/94
JP 2003-97473 4/2003
JP 2003097479 A * 4/2003
JP 2005240743 A * 9/2005

* cited by examiner

*Primary Examiner*—Theresa Trieu
(74) *Attorney, Agent, or Firm*—Kratz, Quintos & Hanson, LLP

(57) ABSTRACT

A rotary compressor including upper and lower cylinders constituting first and second rotary compression elements; a lower support member which closes an opening of the lower cylinder and which has a bearing as a bearing portion of a rotation shaft; a discharge muffler chamber formed by depressing an outer surface of the bearing of the lower support member on the side opposite to the lower cylinder to close the depressed portion with a lower cover; an O-ring groove formed in the surface of the bearing which abuts on the lower cover; an O-ring stored in the O-ring groove; and a gasket disposed between the lower support member. The lower cover in an outer peripheral portion of the lower support member, and the surface of the lower cover on the side of the lower support member, is provided with a stepped portion to absorb a thickness of the gasket.

3 Claims, 3 Drawing Sheets

ROTARY COMPRESSOR HAVING A STEPPED COVER OF A DISCHARGE MUFFLER CHAMBER

BACKGROUND OF THE INVENTION

The present invention relates to a rotary compressor including a driving element and a rotary compression element driven by a rotation shaft of this driving element, the elements being disposed in a sealed container.

Heretofore, this type of rotary compressor, for example, a multistage compression type rotary compressor including first and second rotary compression elements is constituted of a driving element and first and second rotary compression elements driven by a rotation shaft of this driving element, the elements being disposed in a sealed container.

As to the first and second rotary compression elements, the second rotary compression element is disposed on an upper side, and the first rotary compression element is disposed on a lower side via an intermediate partition plate. That is, the first and second rotary compression elements are constituted of: upper and lower cylinders disposed on and under the intermediate partition plate; rollers fitted into eccentric portions disposed on the rotation shaft with a phase difference of 180 degrees to eccentrically rotate in these cylinders; vanes which abut on the respective rollers to define the insides of the cylinders on low-pressure and high-pressure chamber sides; an upper support member which closes an upper opening of the upper cylinder and which has a bearing portion of the rotation shaft; a lower support member which closes a lower opening of the lower cylinder and which has a bearing portion of the rotation shaft; and discharge muffler chambers formed by depressing the outer surfaces of the bearing portions of the respective support members on the side opposite to the respective cylinders to close the depressed portions with covers.

Moreover, a low-pressure refrigerant gas is sucked into the lower cylinder of the first rotary compression element on the side of the low-pressure chamber, and compressed by operations of the roller and vane to obtain an intermediate pressure. The refrigerant gas which has reached the intermediate pressure is discharged from the high-pressure chamber side of the lower cylinder to the discharge muffler chamber via a discharge port. Thereafter, the refrigerant gas is sucked into the upper cylinder of the second rotary compression element on the side of the low-pressure chamber. Then, the refrigerant gas is compressed by the operation of the roller and vane to form a high-temperature high-pressure refrigerant gas, and the gas is discharged from the high-pressure chamber to the discharge muffler chamber (see, e.g., Japanese Patent Application Laid-Open No. 2003-97473).

Here, in the above-described rotary compressor, an O-ring groove is formed in the surface of the bearing portion of the lower support member which abuts on the cover, an O-ring is disposed in the groove, and a gasket is disposed between the cover and the lower support member in an outer peripheral portion of the compressor, thereby constituting a structure in which the discharge muffler chamber is sealed. Here, the cover has to be brought into contact with the support member in the bearing portion, but an interval between the cover and the lower support member has to be set to be equal to a thickness of the gasket to be disposed therebetween in the outer peripheral portion. Therefore, a stepped portion has heretofore been disposed on the surface of the lower support member on the side of the cover. That is, this problem has been handled by protruding an end of the bearing portion as much as the thickness of the gasket on the side of the cover.

However, working of the lower support member becomes complicated, and it is difficult to reduce a dimensional tolerance. This causes a problem that production costs of the rotary compressor suddenly rise, and sealability by the O-ring deteriorates.

SUMMARY OF THE INVENTION

The present invention has been developed to solve such problems of the conventional technology, and an object is to improve sealability of an O-ring and a performance of a rotary compressor.

A rotary compressor of a first aspect of the present invention provided with a sealed container containing a driving element and a rotary compression element driven by a rotation shaft of this driving element, the rotary compressor comprising: a cylinder constituting the rotary compression element; a support member which closes an opening of this cylinder and which has a bearing portion of the rotation shaft; a discharge muffler chamber formed by depressing an outer surface of the bearing portion of the support member on the side opposite to the cylinder to close this depressed portion with a cover; an O-ring groove formed in the surface of the bearing portion which abuts on the cover; an O-ring stored in the O-ring groove; and a gasket disposed between the support member and the cover in an outer peripheral portion of the support member, the surface of the cover on the side of the support member being provided with a stepped portion to absorb a thickness of the gasket.

In the rotary compressor of a second aspect of the present invention, the surface of the cover which abuts on the bearing portion is protruded on the side of the support member in the above-described invention.

In the rotary compressor of a third aspect of the present invention, in the above-described inventions, the rotary compression element is constituted of first and second rotary compression elements, the second rotary compression element is disposed on the side of the driving element in the sealed container, the first rotary compression element is disposed on the side opposite to the driving element, the opening of the cylinder of the first rotary compression element on the side opposite to the driving element is closed with the support member, and a refrigerant compressed by the first rotary compression element is compressed by the second rotary compression element to discharge the refrigerant into the sealed container.

According to the rotary compressor of the first aspect of the present invention, since the stepped portion to absorb the thickness of the gasket is disposed on the surface of the cover on the side of the support member, the stepped portion can be easily worked.

Consequently, fluctuations of dimensional tolerances can be reduced, and the dimensional tolerances can be reduced. Therefore, while production costs are reduced, sealability of the O-ring can be improved.

Especially, when the surface of the cover which abuts on the bearing portion is protruded on the side of the support member as in the second aspect of the present invention, the sealability of the O-ring can be secured without decreasing a volume of the discharge muffler chamber.

Moreover, in a high inner pressure type rotary compressor in which the refrigerant compressed by the first rotary compression element is compressed by the second rotary compression element and discharged into the sealed container as in the third aspect of the present invention, the present invention is applied to the first rotary compression element having a large pressure difference from the inside of the sealed container. In consequence, a volume efficiency of the first rotary compression element can be improved.

DETAILED DESCRIPTION OF THE PREFERRED EMBODIMENT

There will be described hereinafter an embodiment of a multistage compression type rotary compressor of the present invention in detail with reference to the drawings.

Figure 1:
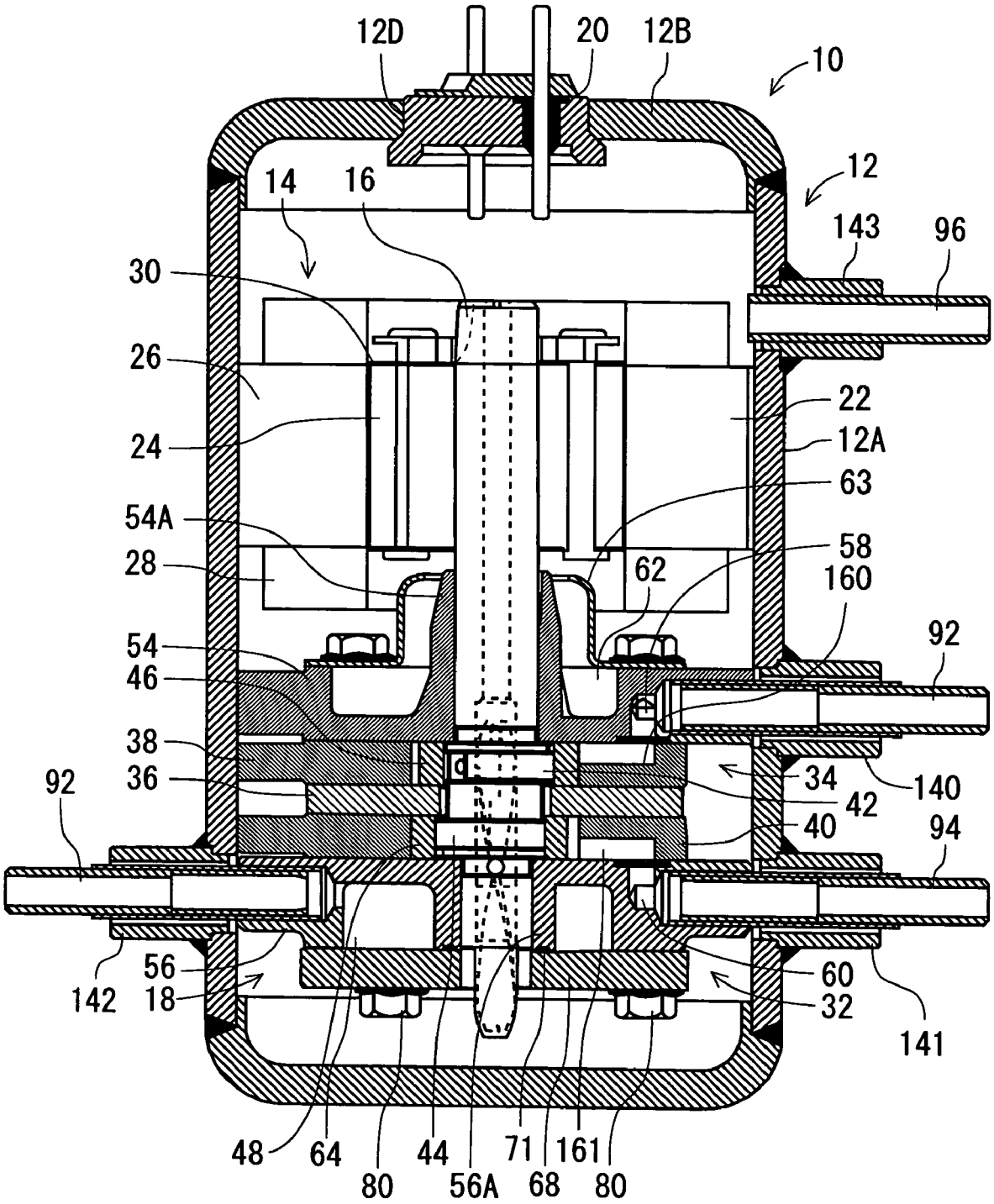
FIG. 1 is a vertical side view of a rotary compressor in one embodiment of the present invention.

In FIG. 1, a rotary compressor 10 of the present embodiment is a high inner pressure type rotary compressor in which a rotary compression element is constituted of first and second rotary compression elements 32, 34. A refrigerant compressed by the first rotary compression element 32 is compressed by the second rotary compression element 34 and discharged into a sealed container 12. In the vertical cylindrical sealed container 12 constituted of a steel plate, there are disposed an electromotive element 14 as a driving element disposed in an upper part of an inner space of the sealed container 12, and a rotary compression mechanism section 18 driven by a rotation shaft of the electromotive element 14. It is to be noted that in the present embodiment, carbon dioxide is used as the refrigerant in the rotary compressor.

The sealed container 12 is constituted of: a container main body 12A whose bottom is an oil reservoir and which contains the electromotive element 14 and the rotary compression mechanism section 18; and an end cap (lid member) 12B which closes an upper opening of this container main body 12A and which substantially has a bowl shape. Moreover, a circular attaching hole 12D is formed in the top of this end cap 12B, and the attaching hole 12D is provided with a terminal (wiring line is omitted) 20 for supplying power to the electromotive element 14.

The electromotive element 14 is constituted of a stator 22 annularly welded and fixed along an inner peripheral surface of the sealed container 12 in the upper space, and a rotor 24 inserted and disposed with a slight interval from an inner wall of this stator 22. This rotor 24 is fixed to a rotation shaft 16 passing through the center in a vertical direction.

The stator 22 has a laminate 26 formed by laminating donut-shaped electromagnetic steel plates and a stator coil 28 wound around a tooth portion of this laminate 26 by a direct winding (concentrated winding) system. The rotor 24 is constituted of a laminate 30 of electromagnetic steel plates in the same manner as in the stator 22.

As to the first and second rotary compression elements 32, 34, the second rotary compression element 34 constituting a second stage via an intermediate partition plate 36 is disposed on the side of the electromotive element 14 in the sealed container 12, and the first rotary compression element 32 constituting a first stage is disposed on a side opposite to the electromotive element 14. That is, the first and second rotary compression elements 32, 34 are constituted of: the intermediate partition plate 36; upper and lower cylinders 38, 40 disposed on and under this intermediate partition plate 36 and constituting the first and second rotary compression elements 32, 34; rollers 46, 48 fitted into eccentric portions 42, 44 disposed on the rotation shaft 16 with a phase difference of 180 degrees in the upper and lower cylinders 38, 40 to eccentrically rotate in the cylinders 38, 40; vanes (not shown) which abut on the respective rollers 46, 48 to define the insides of the cylinders 38, 40 on low-pressure and high-pressure chamber sides; an upper support member 54 which closes an (upper) open face of the upper cylinder 38 on the side of the electromotive element 14 of the upper cylinder 38 and which has a bearing portion 54A of the rotation shaft 16; and a lower support member 56 which closes a (lower) open face of the lower cylinder 40 on the side opposite to the electromotive element 14 and which is a support member having a bearing 56A as a bearing portion of the rotation shaft 16.

The upper and lower support members 54, 56 include: suction passages 58, 60 which communicate with the upper and lower cylinders 38, 40 via suction ports 160, 161, respectively; a discharge muffler chamber 62 formed by depressing the (upper) surface of the upper support member 54 on the side opposite to the upper cylinder 38 to close the depressed portion with an upper cover 63; and a discharge muffler chamber 64 formed by depressing the (lower) outer surface of the bearing portion 56A of the lower support member 56 on the side opposite to the lower cylinder 40 to close the depressed portion with a lower cover 68. That is, the discharge muffler chamber 62 is closed with the upper cover 63, and the discharge muffler chamber 64 is closed with the lower cover 68.

In this case, the bearing 54A is raised in the center of the upper support member 54. The bearing 56A is formed through the center of the lower support member 56. The bearing 56A centers on the rotation shaft 16, and substantially has a donut shape having, in the center thereof, a hole which passes the rotation shaft 16. The above-described discharge muffler chamber 64 is disposed externally from the bearing 56A (in an outer periphery of the bearing). Moreover, an O-ring groove 70 described later is formed in the surface of the bearing 56A which abuts on the lower cover 68.

The lower cover 68 is constituted of a donut-shaped circular steel plate, and fixed to the lower support member 56 from below via four bolts 80 . . . in a peripheral portion to close a lower opening of the discharge muffler chamber 64 which communicates with the lower cylinder 40 of the first rotary compression element 32 via a discharge port (not shown). Tips of the bolts 80 . . . engage with the upper support member 54.

Figure 2:
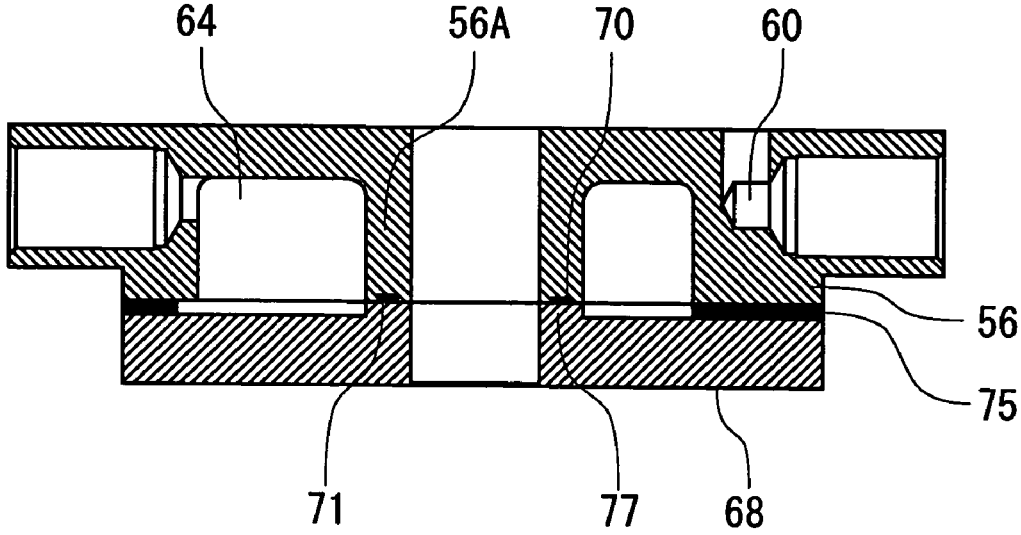
FIG. 2 is a vertical side view showing a lower support member and a lower cover of a first rotary compression element of the rotary compressor shown in FIG. 1.
Figure 3:
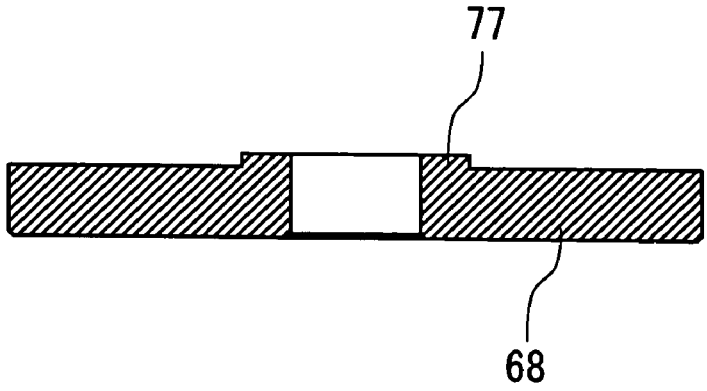
FIG. 3 is a vertical side view showing the lower cover of the first rotary compression element of the rotary compressor shown in FIG. 1.

The above-described O-ring groove 70 stores an O-ring 71 which seals the inside (rotation shaft 16) of the discharge muffler chamber 64. That is, a gap between the bearing 56A of the lower support member 56 and the lower cover 68 is sealed with the O-ring 71 stored in the O-ring groove 70. A gasket 75 (FIG. 2) is disposed between the lower support member 56 and the lower cover 68 in a portion of the lower support member 56 other than the bearing 56A, that is, the outer peripheral portion of the lower support member 56 constituting an outer portion of the discharge muffler chamber 64. An outer surface of the discharge muffler chamber 64 is sealed with the gasket 75.

Here, the above-described O-ring groove 70 is formed in the bearing 56A of the lower support member 56 constituting the inner surface of the discharge muffler chamber 64, and the O-ring 71 is stored in the O-ring groove 70 to seal the bearing 56A and the lower cover 68. The gasket 75 is disposed between the lower support member 56 and the lower cover 68 on an outer peripheral side of the discharge muffler chamber 64 to seal the outer peripheral side of the discharge muffler chamber 64. Therefore, the lower support member 56 needs to abut on the lower cover 68 in the bearing 56A of the lower support member 56, and an interval corresponding to the thickness of the gasket 75 needs to be disposed between the outer peripheral portion of the lower support member and the lower cover 68.

Figure 4:
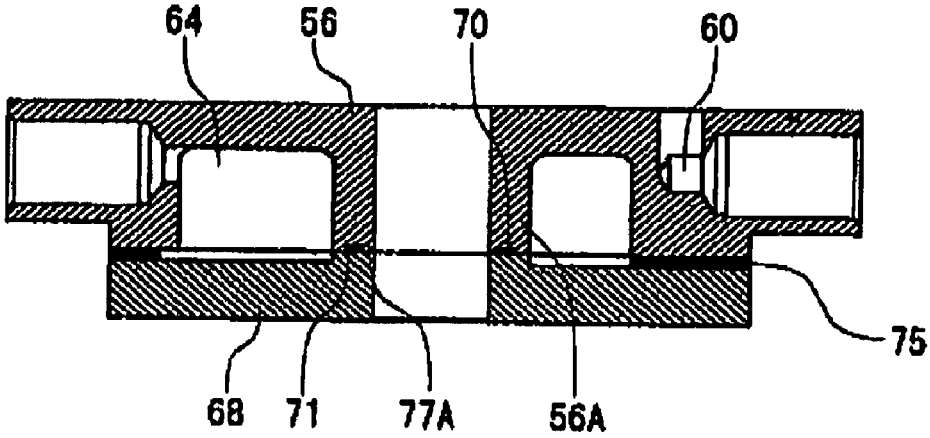
PRIOR ART FIG. 4
FIG. 4 is a vertical side view showing a lower support member and a lower cover of a first rotary compression element of a conventional rotary compressor.
Figure 5:
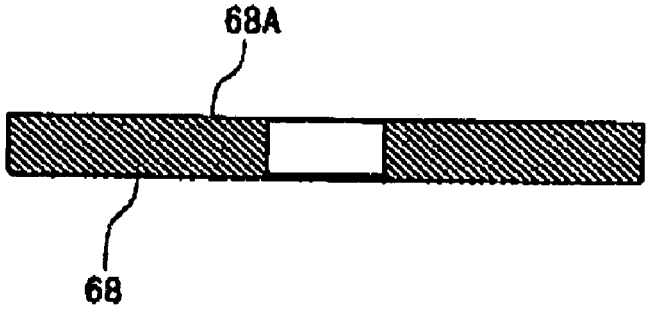
PRIOR ART FIG. 5
FIG. 5 is a vertical side view showing the lower cover of the first rotary compression element of the conventional rotary compressor.

Therefore, a stepped portion corresponding to the thickness of the gasket 75 has to be disposed in the surface provided with the gasket 75 and the bearing 56A which is not provided with the gasket 75. Such stepped portion has heretofore been formed on the surface of the lower support member 56 on the side of the lower cover 68. That is, as shown in FIG. 4, an end of the bearing 56A is protruded as much as the thickness of the gasket 75 on the side of the lower cover 68 (stepped portion 77A in the drawing) to obtain the interval corresponding to the thickness of the gasket 75. Therefore, as shown in FIG. 5, the surface 68A of the lower cover 68 on the side of the lower support member 56 has heretofore been formed into a flat and smooth surface that does not have any stepped portion.

However, in a case where the lower support member 56 is formed into a shape having the stepped portion 77A as described above, working of the lower support member 56 becomes complicated, workability drops, and it is therefore difficult to reduce a dimensional tolerance of the stepped portion 77A. This causes a problem that production costs of the rotary compressor 10 suddenly rise, and sealability of the O-ring 71 deteriorates.

To solve the problem, in the rotary compressor 10 of the present invention, the surface of the lower cover 68 on the side of the lower support member 56 is provided with a stepped portion 77 for absorbing the thickness of the gasket 75 to handle the thickness of the gasket 75. That is, in the rotary compressor 10 of the present embodiment, the surface of the lower cover 68 which abuts on the bearing 56A is protruded on the side of the lower support member 56. When the lower cover 68 is provided with the stepped portion 77 for absorbing the thickness of the gasket 75 in this manner, the stepped portion can be worked more easily than in a case where the lower support member 56 is provided with the stepped portion 77A. Consequently, production costs can be reduced.

Furthermore, when the lower cover 68 is provided with the stepped portion 77, fluctuations of dimensional tolerances can be reduced, and the dimensional tolerance can be reduced. In consequence, the sealability of the O-ring 71 can be improved.

Especially in the present embodiment, the present invention is applied to the first rotary compression element 32 of a so-called high inner pressure type rotary compressor in which the refrigerant compressed by the first rotary compression element 32 is compressed by the second rotary compression element 34 and discharged into the sealed container 12. That is, since there is a pressure difference between the sealed container 12 having a high pressure and the discharge muffler chamber 64 into which an intermediate-pressure refrigerant is discharged, it is important to secure the sealability.

Moreover, in a case where carbon dioxide having a large pressure level difference is used as the refrigerant as in the present embodiment, a pressure difference between the sealed container 12 and the discharge muffler chamber 64 becomes very large. Therefore, the refrigerant easily leaks from a gap between the bearing 54A and the lower cover 68, and there is a danger that a volume efficiency of the first rotary compression element 32 remarkably deteriorates owing to the deterioration of the workability.

However, when the lower cover 68 is provided with the stepped portion 77 as described above to suppress the fluctuations of the dimensional tolerances, refrigerant leak into the discharge muffler chamber 64 is inhibited, and it is possible to avoid in advance the deterioration of the volume efficiency of the first rotary compression element 32.

Furthermore, when the only surface of the lower cover 68 that abuts on the bearing 56A is protruded on the side of the lower support member 56 as in the present embodiment, a disadvantage that the volume of the discharge muffler chamber 64 decreases is not generated. That is, for example, in a case where the stepped portion of the lower cover 68 is disposed in such a position as to abut on the inner surface of the gasket 75, the sealability of the O-ring 71 can be secured, but the volume of the discharge muffler chamber 64 decreases owing to the stepped portion. This generates a danger that a muffling effect of the discharge muffler chamber 64 decreases.

However, when the only surface of the lower cover 68 that abuts on the bearing 56A is protruded on the side of the lower support member 56 as described above, the sealability of the O-ring 71 can be secured without decreasing the volume of the discharge muffler chamber 64.

On the other hand, the upper cover 63 is provided with a communication path (not shown) which connects the discharge muffler chamber 62 to the sealed container 12, and a high-temperature high-pressure refrigerant gas compressed by the second rotary compression element 34 is discharged into the sealed container 12 via the communication path.

Moreover, sleeves 140, 141, 142, and 143 are welded and fixed to the side of the container main body 12A of the sealed container 12 in positions corresponding to the suction passages 58, 60 of the upper and lower support members 54, 56 and upper parts of the discharge muffler chamber 64 and the electromotive element 14, respectively. The sleeve 140 is vertically adjacent to the sleeve 141, and the sleeve 143 is disposed substantially diagonally with respect to the sleeve 141.

One end of a refrigerant introducing tube 92 for introducing the refrigerant gas into the upper cylinder 38 is inserted and connected into the sleeve 140, and one end of this refrigerant introducing tube 92 is connected to the suction passage 58 of the upper cylinder 38. This refrigerant introducing tube 92 passes through the upper part of the sealed container 12 and reaches the sleeve 142. The other end of the refrigerant introducing tube is inserted and connected into the sleeve 142 to communicate with the discharge muffler chamber 64.

Moreover, one end of a refrigerant introducing tube 94 for introducing the refrigerant gas into the lower cylinder 40 is inserted and connected into the sleeve 141, and one end of this refrigerant introducing tube 94 is connected to the suction passage 60 of the lower cylinder 40. A refrigerant discharge tube 96 is inserted and connected into the sleeve 143, and one end of the refrigerant discharge tube 96 is connected into the sealed container 12.

Next, there will be described an operation of the rotary compressor 10 constituted as described above. When the stator coil 28 of the electromotive element 14 is energized via the terminal 20 and the wiring line (not shown), the electromotive element 14 is started to rotate the rotor 24. This rotation results in eccentric rotation of the rollers 46, 48 fitted into the upper and lower eccentric portions 42, 44 disposed integrally with the rotation shaft 16 in the upper and lower cylinders 38, 40.

Accordingly, a low-pressure refrigerant gas sucked from the suction port 161 into the lower cylinder 40 on the low-pressure chamber side via the refrigerant introducing tube 94 and the suction passage 60 formed in the lower support member 56 is compressed by the operations of the roller 48 and the vane (not shown) to obtain an intermediate pressure. The compressed intermediate-pressure refrigerant gas is discharged from the lower cylinder 40 on the high-pressure chamber side into the discharge muffler chamber 64 formed in the lower support member 56 via the discharge port (not shown).

Moreover, the intermediate-pressure refrigerant gas discharged into the discharge muffler chamber 64 passes through the refrigerant introducing tube 92 which communicates with the discharge muffler chamber 64, and the gas is sucked from the suction port 160 to the upper cylinder 38 on the low-pressure chamber side via the suction passage 58 formed in the upper support member 54.

The intermediate-pressure refrigerant gas sucked into the upper cylinder 38 is compressed in the second stage by the operations of the roller 46 and the vane (not shown) to form a high-temperature high-pressure refrigerant gas. Moreover, the high-temperature high-pressure refrigerant gas compressed by the upper cylinder 38 is discharged from the upper cylinder 38 on the high-pressure chamber side to the discharge muffler chamber 62 formed in the upper support member 54 via the discharge port (not shown).

The refrigerant discharged to the discharge muffler chamber 62 is discharged into the sealed container 12 via the communication path (not shown). Thereafter, the refrigerant passes through the gap of the electromotive element 14 to move into the upper part of the sealed container 12, and is discharged to the outside of the rotary compressor 10 from the refrigerant discharge tube 96 connected to the upper part of the sealed container 12.

According to the present invention described above in detail, it is possible to improve the sealability of the O-ring 71 while reducing the production costs, and it is possible to provide the high-performance rotary compressor 10 at a low cost.

It is to be noted that in the present embodiment, as the rotary compressor, there has been described the high inner pressure type rotary compressor 10 including the first and second rotary compression elements 32, 34. The present invention is not limited to this embodiment, and may be applied to a single-stage rotary compressor and a rotary compressor including three or more stages of rotary compression elements. The present invention is not limited to the high inner pressure type rotary compressor, and may be applied to an intermediate inner pressure type rotary compressor and a low inner pressure type rotary compressor.

Moreover, in the present embodiment, the shaft has been described as a vertically disposed type, but, needless to say, the present invention may be applied to a rotary compressor including a horizontally disposed rotation shaft. Furthermore, it has been described that carbon dioxide is used as the refrigerant of the rotary compressor, but another refrigerant may be used.

What is claimed is:

1. A rotary compressor provided with a sealed container containing a driving element and a rotary compression element driven by a rotation shaft of the driving element, the rotary compressor comprising:

a cylinder constituting the rotary compression element;

a lower support member which closes an opening of the cylinder and which has a bearing portion of a rotation shaft;

a discharge muffler chamber formed by depressing an outer surface of the bearing portion of the lower support member on the side opposite to the cylinder;

a cover to close the depressed portion of the lower support member;

an O-ring groove formed in the surface of the bearing portion which abuts on the cover;

an O-ring stored in the O-ring groove; and a gasket disposed between the lower support member and the cover in an outer peripheral portion of the lower support member, the surface of the cover on the side of the lower support member being provided with a stepped portion to absorb a thickness of the gasket.

2. The rotary compressor according to claim 1, wherein the surface of the cover which abuts on the bearing portion is protruded on the side of the lower support member.

3. The rotary compressor according to claim 1 or 2, wherein the rotary compression element is constituted of first and second rotary compression elements, the second rotary compression element is disposed on the side of the driving element in the sealed container, the first rotary compression element is disposed on the side opposite to the driving element, the opening of the cylinder of the first rotary compression element on the side opposite to the driving element is closed with the lower support member, and a refrigerant compressed by the first rotary compression element is compressed by the second rotary compression element to discharge the refrigerant into the sealed container.

* * * * *